US006475044B1

(12) United States Patent
Jones

(10) Patent No.: US 6,475,044 B1
(45) Date of Patent: Nov. 5, 2002

(54) VIBRATION ISOLATION FOR MOUNTING WATER JET PROPULSION UNIT TO HULL

(75) Inventor: James R. Jones, Neosho, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/724,054

(22) Filed: Nov. 28, 2000

(51) Int. Cl.[7] ..... B63H 11/00
(52) U.S. Cl. ..... 440/38; 440/52
(58) Field of Search ..... 440/38, 52

(56) References Cited

U.S. PATENT DOCUMENTS 5,310,368 A * 5/1994 Kamitake ..... 440/38
6,019,648 A * 2/2000 Lecours et al. ..... 440/38
6,231,409 B1 * 5/2001 Kato ..... 440/38

* cited by examiner

*Primary Examiner*—Jesus D. Sotelo
(74) *Attorney, Agent, or Firm*—Ostrager Chong & Flaherty LLP

(57) ABSTRACT

A jet-propelled boat has a hull, a mounting adapter mounted to the hull, a water jet propulsion system mounted to the mounting adapter, and seals arranged at the interface of the hull and the mounting adapter. The seals are made of a vibration isolation material such as rubber. The mounting adapter has a mounting flange which opposes a portion of the hull transom. A first seal is a generally planar layer of flexible vibration isolation material arranged between and in contact with the transom and the mounting flange. The mounting adapter also has an inlet housing which sits inside an inlet ramp formed in the hull. The inlet ramp has a recess for receiving a leading portion of the inlet housing. A second seal is a bead of flexible vibration isolation material placed in the recess. The bead sits between and in contact with the inlet ramp and the leading portion of the inlet housing. The first and second seals are preferably formed as a single molded piece, with the seals being connected by strips formed during molding.

32 Claims, 4 Drawing Sheets

VIBRATION ISOLATION FOR MOUNTING WATER JET PROPULSION UNIT TO HULL

FIELD OF THE INVENTION

This invention generally relates to water jet-propelled boats or watercraft having an inboard motor and an outboard water jet propulsion unit. In particular, the invention relates to methods for suppressing noise and damping vibrations produced by the outboard water jet propulsion unit.

BACKGROUND OF THE INVENTION

It is known to propel a boat or other watercraft using a water jet apparatus mounted to the hull, with the powerhead being placed inside (inboard) the hull. The driven shaft of the water jet apparatus is coupled to the drive shaft of the inboard motor. The impeller is mounted on the driven shaft and housed in a jet propulsion duct or water tunnel or housing.

To facilitate use of water jet-propelled boats in shallow water, it is known to mount the water jet propulsion assembly at an elevation such that the unit does not project below the bottom of the boat hull. This can be accomplished, for example, by installing a duct in the stern of the boat, the duct being arranged to connect one or more inlet holes formed in the bottom of the hull with an outlet hole formed in the transom. The water jet propulsion assembly is then installed outside the hull in a position such that its inlet is in flow communication with the duct outlet at the transom. Alternatively, the water jet impeller can be installed inside the duct built into the hull.

It is further known to integrally form an inlet ramp or tunnel in the stern portion of the bottom of a hull. The inlet ramp comprises a pair of opposing side walls which increase in height continuous-ly from a starting point on the hull bottom to the respective points where the side walls join the hull transom. The top edges of the opposing side walls are connected by a ramp ceiling which curves continuously upward. The side walls and ceiling form part of the hull bottom and define an inlet channel. Optionally, the junctures connecting the side walls to the ceiling may be formed as rounded, as opposed to sharp, corners. A mounting adapter in the form of a flanged ring having a rounded leading lower lip is mounted to the rear face of the hull transom. The bottom edges of the inlet ramp and the forward tip of the lower lip define an inlet opening for entry of ambient water into the inlet channel formed by the inlet ramp.

The mounting adapter is mounted to the transom by fasteners. The water jet propulsion assembly is in turn mounted to the mounting adapter in cantilever fashion in a well-known manner. The outlet of a discharge nozzle of the water jet propulsion assembly is in flow communication with the inlet opening in the hull bottom via the hull inlet ramp, the mounting adapter, and one or more housings of the water jet propulsion assembly itself (e.g., an impeller housing and a stator housing). All of these components, communicating with each other in series, form a duct having a channel with an inlet and an outlet. Rotation of an impeller, driven by an inboard. motor, produces flow through the duct in a well-known manner.

In accordance with the latter design, the water jet propulsion system, is mounted to the hull by means of a mounting adapter, which is typically made of metal, e.g., aluminum alloy. Acoustic waves (i.e., noise) generated during operation of the water jet propulsion system are transmitted to the mounting adapter, which in turn provides a path for acoustic waves to impinge on the hull and even enter the hull via penetrations, e.g., bolts which fasten the mounting adapter to the transom. This increases the levels of noise which the boat passengers or watercraft riders are exposed to. Similarly, if the mounting adapter is bolted directly to the hull, and the water jet propulsion unit is in turn bolted to the mounting adapter, then vibrations produced by the rotating impeller will cause the duct of the propulsion to vibrate, which in turn causes the adapter to vibrate, which in turn causes the hull to vibrate, and so forth.

There is a need for means and techniques for reducing the levels of noise and vibration to which boat passengers and watercraft riders are exposed. The means for reducing noise and vibrations reaching the hull should also act as a seal preventing ingress of water into the hull and ingress of air into the duct of the water jet propulsion system. Such means for reducing noise and vibration levels should be easy to install and relatively inexpensive to manufacture.

SUMMARY OF THE INVENTION

The present invention is directed to a jet-propelled boat comprising a water jet propulsion unit which is mounted to the boat hull by means of vibration isolators. In accordance with the preferred embodiment, vibration isolation material is inserted between the water jet propulsion system and the boat hull at every point where, in the absence of the vibration isolation material, the water jet propulsion system would contact the boat hull.

A jet-propelled boat in accordance with a preferred embodiment comprises a hull, a mounting adapter mounted to the hull, a water jet propulsion system mounted to the mounting adapter, and seals arranged at the interface of the hull and the mounting adapter. The seals are made of a vibration isolation material such as rubber. The mounting adapter comprises a mounting flange which opposes a portion of the hull transom. A first seal comprises a generally planar layer of flexible vibration isolation material arranged between and in contact with the transom and the mounting flange. The mounting adapter also comprises an inlet housing which sits inside an inlet ramp formed in the hull. [A mounting adapter comprising an inlet housing and a mounting flange will occasionally be referred to herein as an "inlet adapter".] The inlet ramp has a recess for receiving a leading portion of the inlet housing. A second seal comprises a bead of flexible vibration isolation material placed in the recess. The bead sits between and in contact with the inlet ramp and the leading portion of the inlet housing. The first and second seals are preferably formed as a single molded piece, with the seals being connected by strips formed during molding.

The present invention is further directed to a compound seal for isolating a boat hull from vibrations produced during operation of a water jet propulsion unit mounted to the hull. A compound seal in accordance with a preferred embodiment comprises: a generally planar layer of flexible material having a peripheral edge forming a generally U-shaped opening; a generally U-shaped bead made of flexible material, the shapes and sizes of the opening and bead being generally similar, and means for connecting the bead to the layer. The bead lies generally parallel to the layer and is separated therefrom. The bead is generally aligned with and overlies the peripheral edge of the layer when viewed from in front of the bead along a line of sight generally perpendicular to the layer. Preferably the bead, layer and connecting means are made of the same flexible vibration isolation material, e.g., rubber, and are parts of a single molded piece.

By placing vibration isolation material at the interface of the mounting adapter and the hull, the hull can be substantially isolated from the vibrations produced during operation of the water jet propulsion unit. In addition, since typical vibration isolation material has high acoustic impedance, a substantial portion of the acoustic waves are absorbed or reflected, rather than being transmitted from the water jet propulsion unit to the unit. This reduces noise levels inside the boat. Furthermore, because the preferred vibration isolation material is flexible, when compressed between the mounting adapter and the hull, the isolation material acts as a water seal which prevents the ingress of water into the hull, e.g., via hull penetrations.

DETAILED DESCRIPTION OF THE PREFERRED EMBODIMENTS

Figure 1:
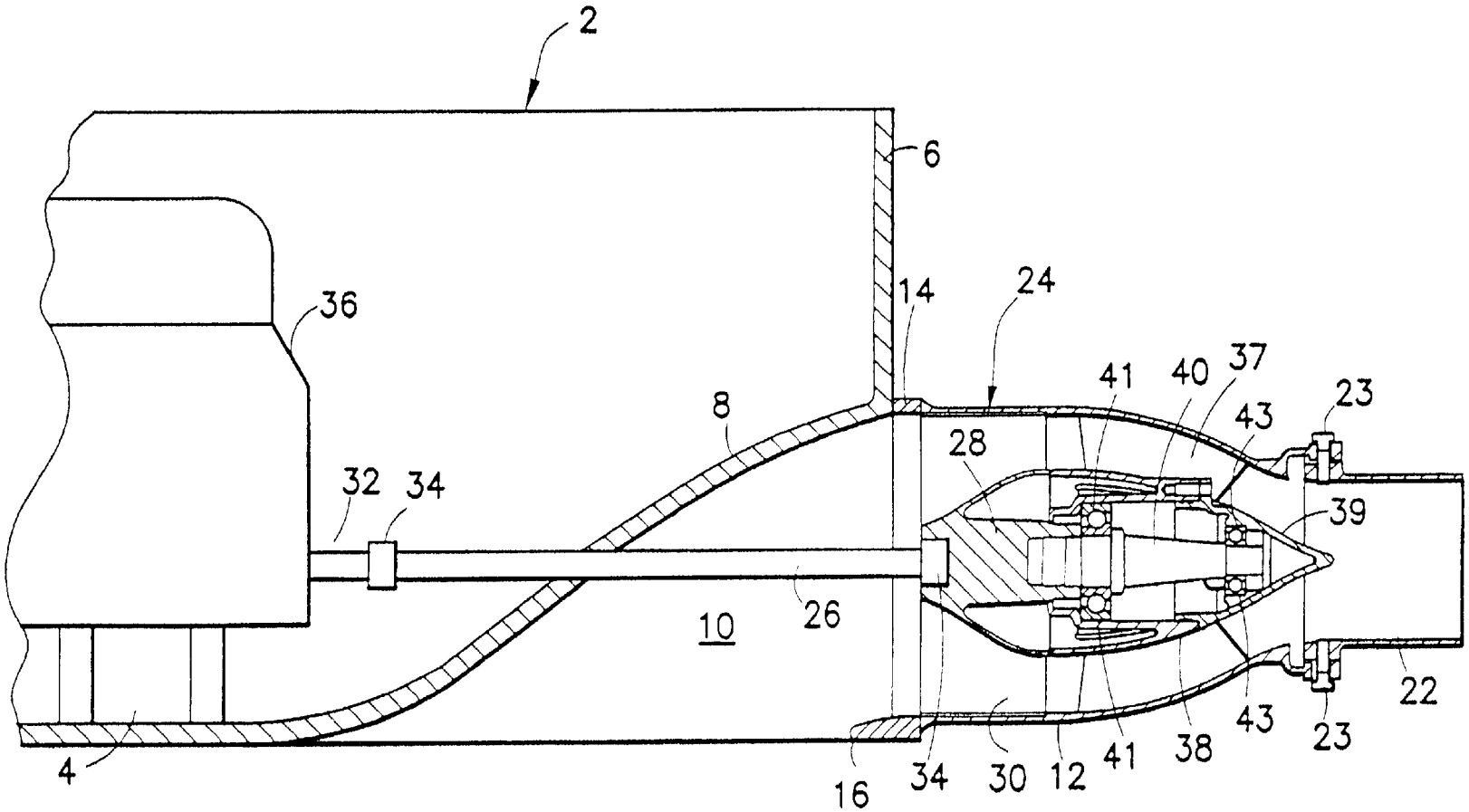
FIG. 1 PRIOR ART
FIG. 1 is a schematic showing a sectional view of the stern portion of a boat or watercraft having a water jet propulsion system mounted to the hull via a mounting adapter made of metal alloy. The invention is not shown.

The stern portion of one type of jet-propelled boat is shown in FIG. 1. A hull 2 comprises a bottom 4, a stern wall or transom 6, an inlet ramp 8 integrally formed in the hull bottom, and a bow (not shown). Preferably the hull is fabricated from aluminum or is molded by applying a lamination of fiberglass matting and resin in a mold and then allowing the laminate to cure. The inlet ramp 8 is formed as part of the hull bottom during the manufacturing operation. The inlet ramp 8 increases continuously in height from a starting point at the hull bottom 4 to a maximum height at the transom 6. The inlet ramp defines an inlet channel 10 which is open at the hull bottom and at the transom.

In accordance with the boat design depicted in FIG. 1, a water jet propulsion assembly is mounted to the transom 6 by means of a mounting adapter 14. The water jet propulsion assembly is cantilevered from mounting adapter 14, which is mounted to the rear face of the transom 6 by fasteners (not shown). Preferably, mounting adapter 14 is a flanged ring having a rounded lower lip 16. The bottom edges of the inlet ramp 8 and the leading edge of the lower lip 16 define an inlet opening for entry of ambient water into the inlet channel 10.

The water jet propulsion assembly may, for example, comprise an integrally formed stator housing/exit nozzle 12 fastened to the mounting adapter 14. Alternatively, the stator housing and exit nozzle may be separate components. The exit nozzle discharges the impelled water into a steering nozzle 22. The steering nozzle is pivotably mounted to the exit nozzle in a conventional manner. The inlet of the steering nozzle 22 is in flow communication with the inlet opening via the inlet ramp 8, the mounting adapter 14, and the stator housing/exit nozzle 12.

As seen in FIG. 1, the water jet propulsion assembly typically comprises an impeller 24 coupled to the driven shaft 26 via a flexible coupling 34. The impeller typically comprises an impeller hub 28 coupled to a splined end of the driven shaft 26 for rotation therewith and a plurality of impeller blades 30 which extend generally radially outward from the hub. The impeller blades 30 are spaced at equal angular intervals around the circumference of the impeller hub 28. Preferably the hub and blades of impeller 24 are integrally formed as one cast piece. The outer surface of the impeller hub 28 forms a radially inner boundary for guiding the flow of water through the impeller housing.

Referring to FIG. 1, the driven shaft 26 is driven to rotate by a drive shaft 32 coupled thereto via another flexible coupling 34. The drive shaft 32 is driven to rotate by a motor 36 mounted inside the hull 2, which in turn causes the driven shaft and attached impeller to rotate. As generally depicted in FIG. 1, the driven shaft 26 penetrates the inlet ramp 8, although the means by which this penetration is accomplished are not shown.

Still referring to FIG. 1, the rotating impeller 24 impels water rearward into the stator section. The stator housing/exit nozzle 12 is preferably a cast piece which further comprises a stator hub 38 and a plurality of stator vanes 37 extending radially from the stator hub to the stator housing. A tail cone 39 is attached to the stator hub 38. The impeller hub 28 sits on the threaded end of a short shaft 40 which is rotatably supported by bearings 41 in the stator hub 38 and bearings 43 in the tail cone 39. The stator section restrains the free-spinning impeller from thrusting forward during operation. The outer surface of the stator hub 38 forms a radially inner boundary for guiding the flow of water through the stator housing/exit nozzle 12. The stator vanes 37 are designed to redirect the swirling flow out of the impeller 24 into non-swirling flow. The straightened flow flows through the convergent exit nozzle, which increases the water velocity.

Although FIG. 1 shows one housing for the impeller and stator sections, it will be readily appreciated by persons skilled in the art that separate housings may be used.

Still referring to FIG. 1, the steering nozzle 22 is pivotably mounted to the exit nozzle by means of a pair of pivot pins 23 which are coaxial with a vertical axis. This allows the steering nozzle 22 to be pivoted from side to side for directing thrust to one side or the other for the purpose of steering the boat. The water exiting the steering nozzle creates a reaction force which propels the boat forward. To simplify the drawing, the levers, rods and cables for controlling the angular position of steering nozzle 22 are not shown. Also, the reverse gate and associated levers, rods and cables have not been shown.

Figure 2:
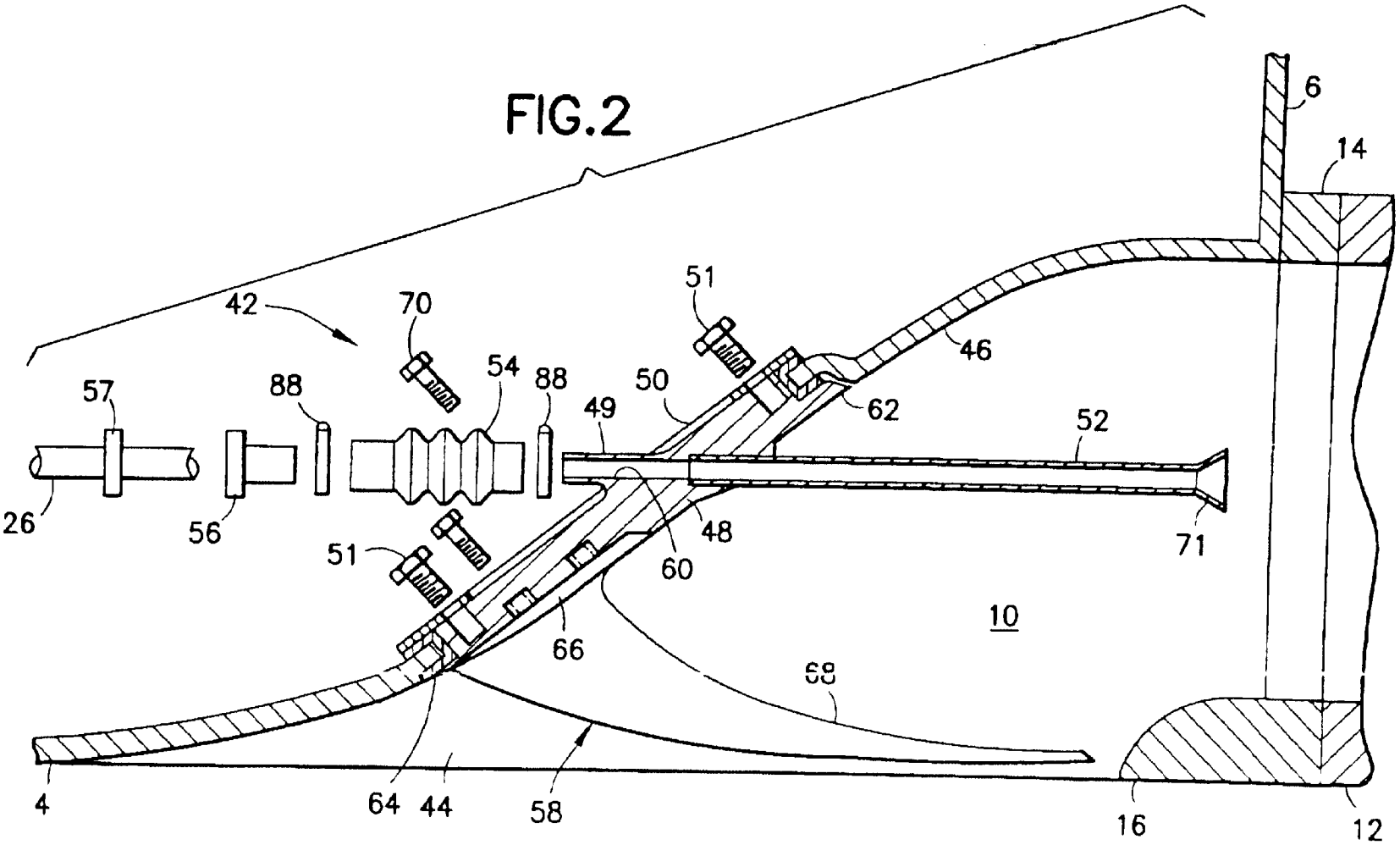
FIG. 2 is a schematic showing a partly sectional and partly exploded view of a through-hull housing assembly which can be installed in the inlet ramp ceiling of the boat shown in FIG. 1, to allow hull penetration by a driven shaft.

One arrangement for shaft penetration of the hull is depicted in FIG. 2. The driven shaft penetrates the hull via a through-hull housing assembly 42 installed in an opening formed in the inlet ramp. The inlet ramp 8 comprises a pair of opposing side walls 44 (only one of which is visible in FIG. 2) which increase in height continuously from a starting point on the hull bottom 4 to the respective points where the side walls join the transom 6. The top edges of the opposing side walls 44 are connected by a ramp ceiling 46, which curves continuously upward. The side walls and ceiling form part of the hull bottom and define inlet channel 10. Optionally, the junctures connecting the side walls to the ceiling may be formed as rounded corners.

As seen in FIG. 2, housing assembly 42 is installed in an opening in the hull bottom, i.e., in the ceiling 46 of the inlet ramp. The assembly 42 comprises a through-hull housing 48, a clamp plate 50, a shaft shroud 52, a bellows 54, a face seal 56 and an inlet grate 58. The entire assembly may be installed in the hull as a module or may be assembled in place. Preferably, the through-hull housing 48 is a thick plate made of metal (e.g., aluminum), structural plastic or reinforced fiberglass. The thick plate comprises a transverse linear bore 60 for passage of the driven shaft through the housing (and hull). The through-hull housing comprises a peripheral flange 62 which sits in a peripheral recess formed along the edge of the opening in the inlet ramp ceiling 46. The recess preferably faces outward from the exterior of the hull. The through-hull housing 48 is clamped to the recessed hull edge, which forms the opening in the inlet ramp, by an annular clamp plate 50 which is preferably installed on the inboard side of the hull. The clamp plate 50 is fastened to the housing 48 by means of a plurality of bolts 51, with the edge of the hull opening being clamped therebetween. Preferably, a grooved mounting grommet 64 is fitted between the peripheral edge of the hull opening and the opposing surfaces of the through-hull housing 48 and clamp plate 50. The grommet 64 is preferably formed from a homogeneous material, e.g., nitrile. The grommet material is squeezed between the clamped components, conforming to the interfacing surfaces to seal against water leaking into the hull via the housing/hull interface.

The housing assembly shown in FIG. 2 further comprises an inlet grate 58 extending from the outboard surface of the through-hull housing 48. The inlet grate 58 comprises a base 66 having a plurality of generally parallel cantilever tines 68 extending therefrom, the base 66 being fastened to the through-hull housing, e.g., by means of bolts 70. Alternatively, the housing and grate could be formed as one cast metal piece, e.g., made of aluminum alloy.

The outboard end of the linear bore 60 has an annular recess of increased diameter for receiving an end of a shaft shroud 52, which is press-fit into the annular recess. The shaft shroud 52 extends rearward and is coaxial with the linear bore. In the fully assembled state, the shaft shroud 52 surrounds the driven shaft as it traverses the inlet channel 10. The shaft shroud 52 prevents weeds, ropes or debris from becoming entangled around the rotating driven shaft. Preferably the shaft shroud is manufactured by swaging a tube. The swaged tube terminates in a flared conical section 72, which enhances the rearward hydrodynamic flow through the duct by diverting water radially outward immediately ahead of the rotating impeller hub. The swaged tube has an internal diameter greater than the outer diameter of the driven shaft, so that the latter may rotate freely inside the tube without rubbing against the shaft shroud. Similarly, the stationary flared conical section 72 is separated from the nose of the rotating impeller hub by a gap. This arrangement is not shown in the drawings.

Still referring to FIG. 2, the through-hull housing 48 further comprises a boss 49 in the form of a circular cylindrical extension integrally formed with the thick plate of the housing. The boss is coaxial with and penetrated by the linear bore 60. A face seal 56 is slid onto the driven shaft 26 until the face of the seal abuts a radial flange 57 on the shaft (not shown in FIG. 2). The face seal is effectively anchored to the boss 49 by means of a flexible bellows 54, which is also penetrated by the driven shaft. For example, one end of the bellows 54 is clamped onto the boss 49 by a first hose clamp 74, while the other end of the bellows is clamped onto the small-diameter portion of the face seal 56 by a second hose clamp 74. The bellows is preferably made of nitrile. The spring tension in the bellows pushes the face of the seal 56 against the radial flange 57, producing a surface pressure that prevents the ingress of water at the seal/flange interface.

The linear bore 60 is sized to provide sufficient clearance for the driven shaft to change its angular orientation by a small angle without contacting the bore wall. Thus there is an annular gap between the driven shaft and the linear bore, which gap, in the absence of sealing means, would provide a pathway for water to enter the hull. In accordance with the preferred embodiment of the invention, the face seal 56 provides the required seal.

Preferably the drive shaft is coupled to the driven shaft by means of a flexible coupling. Flexible couplings are designed to allow the transmission of power between a drive shaft and a driven shaft, and usually include spline teeth which are in full contact along their flanks. These couplings permit axial displacement between the shafts, while maintaining a relatively constant bearing surface, and allow a limited amount of angular misalignment. The amount of misalignment depends upon the tooth shape and the amount of play between teeth and the drive and driven numbers. A flexible coupling is inexpensive and easy to replace, and requires no lubrication or periodic maintenance.

Using flexible couplings, the driven shaft floats between the engine coupling and the impeller coupling, The angle and position of the driven shaft can be freely adjusted as a function of displacement of the motor 36 relative to the hull. The linear bore 60 of the through-hull housing 48 must be sized to allow sufficient clearance for transverse displacement of the driven shaft 26 during vertical displacement of the motor.

Figure 3:
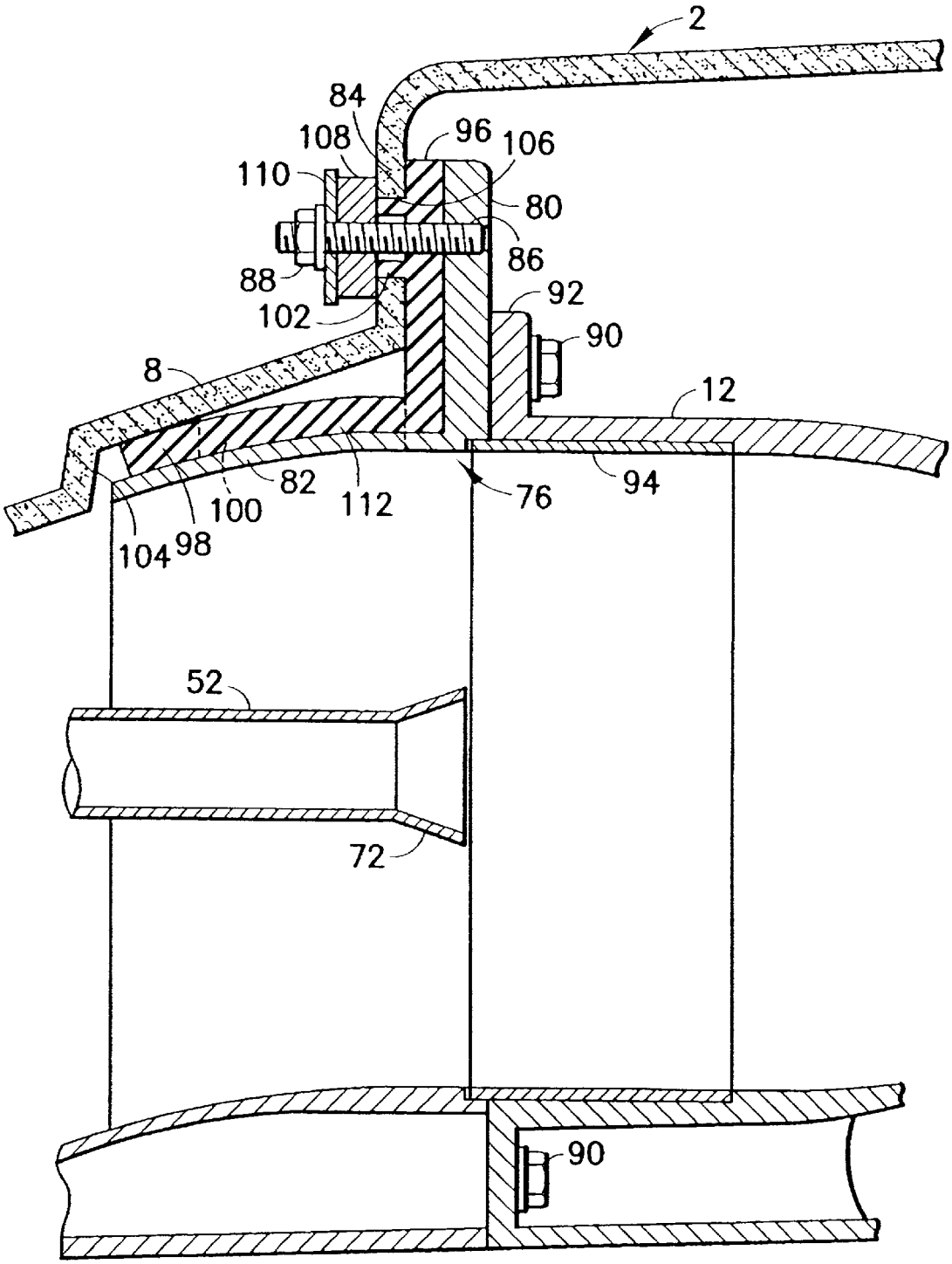
FIG. 3 is a schematic showing a sectional view of an arrangement for mounting a water jet propulsion system to the hull of a boat or watercraft in accordance with the preferred embodiment of the invention.

In accordance with the preferred embodiment of the invention, vibration isolation material is inserted between the water jet propulsion system and the boat hull at every point where, in the absence of the vibration isolation material, the water jet propulsion system would contact the boat hull. Such an arrangement is shown in FIG. 3. In accordance with the preferred embodiment, the water jet propulsion system comprises an inlet adapter 76 mounted to the hull and a housing 12 mounted to the inlet adapter 76. Although not shown in FIG. 3, the impeller is rotatable within the housing 12. The driven shaft to which the impeller is coupled is also not shown in FIG. 3, although it should be understood that the driven shaft passes through the shaft shroud 52, with the nose of the impeller hub being positioned directly behind the conical section 72 of the shaft shroud. The inlet adapter 76 comprises a mounting flange 80, which opposes a vertical hull wall 84, and an inlet housing 82, which sits inside the inlet ramp 8. Preferably the mounting flange 80 and the inlet housing 82 are formed as one cast metal piece. The inlet housing comprises a lower lip 16. The inlet adapter 76 is fastened to hull wall 84 by means of a plurality of studs 86 (only one of which is shown in FIG. 3). Each stud 86 comprises a pair of threaded ends. One threaded end of each stud 86 is threadably coupled to a respective threaded bore in the mounting flange 80. The other threaded end of each stud 86 is threadably coupled to a respective nut 88. Each stud 86 penetrates a corresponding hole formed in the hull wall 84.

The stator housing/exit nozzle 12 is fastened to the inlet adapter 76 by means of a plurality of bolts 90, which fasten a mounting flange 92 (or a plurality of bosses) to the mounting flange 80 of the inlet adapter. A circumferential recess inside the housing 12 at a position opposing the impeller blade tips (not shown) has a circular cylindrical wear ring 94 seated therein. The front edge of the wear ring 94 protrudes into a recess formed on the interior surface of the inlet adapter. When the impeller rotates, ambient water enters the inlet opening formed by the inlet ramp and the lower lip 16, and flows through the inlet housing 82 and stator housing and is discharged from the exit nozzle (not shown in FIG. 3).

Figure 4:
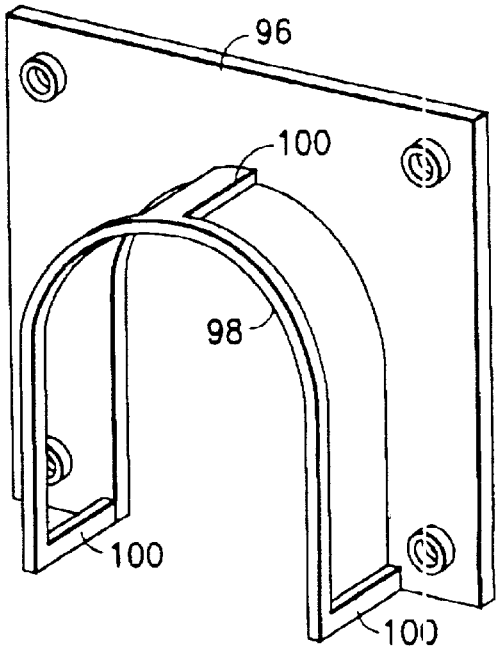
FIG. 4 is a schematic showing an isometric view of an inlet adapter seal in accordance with the preferred embodiment of the invention.

In accordance with the preferred embodiment of the invention, a compound seal is inserted between the inlet adapter 76 and the hull 2. In particular, a first seal 96 is arranged between the mounting flange 80 of the inlet adapter 76 and the hull wall 84; and a second seal 98 is arranged between the inlet housing 82 of the inlet adapter 76 and the hull inlet ramp 8. Each of the seals 96 and 98 is made of vibration isolation material, e.g., rubber. As best seen in FIG. 4, the seals 96 and 98 are connected by a plurality of connecting members 100, only one of which is shown in FIG. 3. Preferably the seals 96 and 98 and the connecting members 100 are all parts of a single molded piece.

Figure 5:
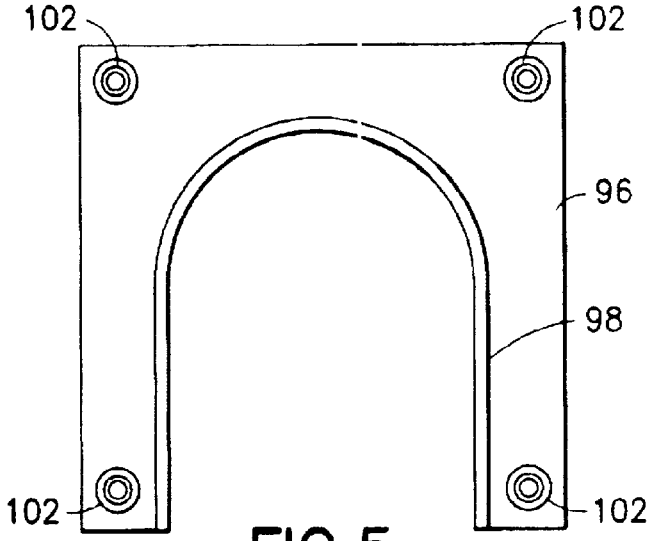
FIGS. 5–7 are schematics showing front, top and side views of the inlet adapter seal depicted in FIG. 4.
Figure 7:
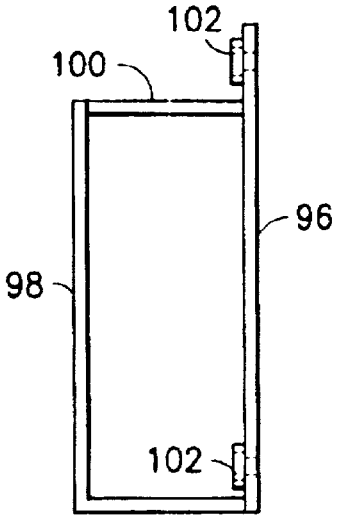
Figure 6:
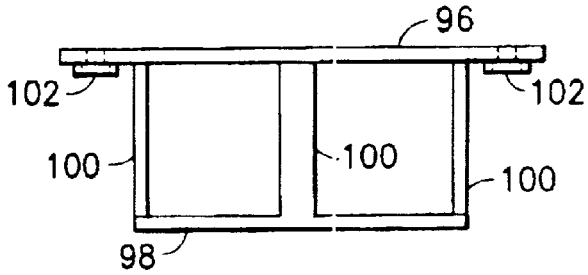

Three views of the compound seal are provided in FIGS. 5–7. As should be apparent from these drawings, the first seal 96 comprises a generally planar layer of flexible vibration isolation material having a peripheral edge forming an arch opening generally shaped like an inverted U, while the second seal 98 comprises an arched bead gegererally shaped like an inverted U and made of flexible vibration isolation material. the shapes and sizes of the U-shaped opening and the U-shaped bead are generally similiar, bearing in mind however that the height of the arched bead in a given case will depend on the height if the inlet ramp at the final position of the bead. The 98 lines generally parallel to the seal 96 and preferably is separated from seal 96 by a relatively constant distance, as seen in FIGS. 6 and 7. As seen in FIGS. 4 and 5, the seal 98 is generally aligned with and overlying the peripheral edge of seal 96 which forms its arched opening.

During assembly, the compound seal is placed over the exterior of the inlet housing 82 with the studs 86 penetrating the corresponding holes in the seal 96. The 10 seal 96 is placed flush against the forward face of the mounting flange 80 of the inlet adapter, while the seal 98 is located adjacent the leading edge of the inlet housing 82. On the side of the seal 96 which faces the hull wall 84, each hole in seal 96 is encircled by a respective annular projection or boss 102 which has an outer diameter not less than the diameter of the hull penetration 106.

After the compound seal is seated on the inlet adapter 76, the inlet adapter is moved into proper position relative to the hull, i.e., the exposed ends of the studs 86 are passed through the corresponding hull penetrations 106, and the inlet housing 82 is inserted into the interior volume of the inlet ramp 8, with seal 98 being seated in a recess 104. Preferably the leading edge of the inlet housing does not contact the inlet ramp. As the studs are inserted, each boss 102 is squeezed into the corresponding hull penetration. Because the boss is made of resilient material and has an outer diameter equal to at least the diameter of the hull penetration, the outer periphery of the boss will press radially outward against the inner periphery of the hull penetration, sealing against the ingress of water.

At this juncture in the assembly process, the inlet adapter 76 is held in position, with the compound seal between the inlet adapter and the hull. In particular, the presence of seal 96 prevents contact between the mounting flange 80 and the hull wall 84, while the presence of seal 98 prevents contact between the inlet housing 82 and the inlet ramp 8. The inlet adapter is then fastened to the hull using the following sequence of steps for each stud. First, an annular seal 108 of flexible vibration isolation material, e.g., rubber, is slid over the protruding end of the stud 86 on the inside of hull wall 84. The annular seal 108 has an outer diameter greater than the diameter if the hull penetration 106 and an inner diameter no greater than the outer diameter if the stud 86. A metal washer 110 is then placed over the annular seal 108. The metal washer preferably has an outer diameter at least equal to the outer diameter of the annular seal. Than a threaded nut 88 is screwed on to the threaded end of sutd 86. The nut 88 is torqued intil the annular seal 108 on one side and the seal 96 on the other side are compressed tightly against hull wall. the resilient material of the compressed seals 96 and 108 fills any spaces or interstices adjacnet the sufaces of the hull penetration, thereby reducing paths for water leaking into the boat. During torquing of the nuts 88, the studs 86 are pulled through the hull penetrations and the inlet adapter 76 is pulled forward, deeper into the interior volume of the inlet ramp 8. Because the outer surface of the inlet housing 82 on which the seal 98 sits is including at a small angle relative to the axes of the studs, forward displacement of the inlet adapter compresses the seal 98 of resilient material against the inlet ramp around the entire periphery of the bead. This creates a tight seal which prevents the escape of air from the volume 112 into the water jet propulsion unit.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

As used in the claims, the term "boat" means a boat, a marine vessel or any type of watercraft; the term "U-shaped" includes shapes with rounded or sharp corners or vertices; and the term "duct" means a fluid flow passage having an inlet and an outlet, the duct being formed by a single housing or a multiplicity of housings connected in series. In the context of the preferred embodiment disclosed herein, the inlet adapter and the stator housing/exit nozzle connected thereto form parts of an exemplary duct.

What is claimed is:

1. A jet-propelled boat comprising:

a hull;

a duct mounted to said hull;

an impeller rotatable within said duct; and vibration isolation material placed between said hull and said duct at every point where, in the absence of the vibration isolation material, vibrations in said duct would be transmitted to said hull.

2. The boat as recited in claim 1, wherein said vibration isolation material is made of rubber.

3. The boat as recited in claim 1, wherein a portion of said hull defines a cavity, said duct comprises an inlet adapter, having a portion seated in said cavity, said vibration isolation material being placed between said portion of said hull and said portion of said inlet adapter.

4. The boat as recited in claim 1, wherein a portion of said hull comprises an inlet ramp having a recess for receiving a leading portion of said duct, and said vibration isolation material comprises a U-shaped bead placed in said recess, said bead sitting between and in contact with said hull and said leading portion of said duct.

5. A jet-propelled boat comprising:

a hull having a generally planar portion;

a duct mounted to said hull, said duct comprising a generally planar mounting flange extending radially outward from said duct;

an impeller rotatable within said duct; and a generally planar vibration isolator placed between and in contact with said generally planar portion of said hull and said generally planar mounting flange.

6. The boat as recited in claim 5, wherein said vibration isolator is made of rubber.

7. A jet-propelled boat comprising:

a hull;

a duct mounted to said hull, said duct comprising a mounting flange;

an impeller rotatable within said duct; and a first vibration isolator placed between and in contact with a first portion of said hull and said mounting flange, wherein said first portion of said hull comprises an opening, and said first vibration isolator comprises an opening aligned with said opening in said hull, further comprising a fastener coupled to said mounting flange and penetrating said opening in said first portion of said hull and said opening in said first vibration isolator, wherein a portion of said first vibration isolator protrudes inside said opening in said first portion of said hull.

8. The boat as recited in claim 7, further comprising a washer in contact with said fastener, said washer being separated from said first portion of said hull by a second vibration isolator.

9. A jet-propelled boat comprising:

a hull;

a duct mounted to said hull, said duct comprising a mounting flange;

an impeller rotatable within said duct; and a first vibration isolator placed between and in contact with a first portion of said hull and said mounting flange, wherein said duct comprises an inlet adapter comprising an inlet housing and said mounting flange, and an impeller housing fastened to said inlet adapter, further comprising a second vibration isolator placed between and in contact with a second portion of said hull and said inlet housing of said inlet adapter.

10. The boat as recited in claim 9, wherein said second portion of said hull comprises an inlet ramp having a recess for receiving a leading portion of said inlet housing, and said second vibration isolator comprises a U-shaped bead placed in said recess, said bead sitting between and in contact with said hull and said leading portion of said inlet housing.

11. The boat as recited in claim 9, further comprising a strip having one end connected to said first vibration isolator and another end connected to said second vibration isolator, said first and second vibration isolators and said strip being made of the same vibration isolation material.

12. A compound seal comprising:

a generally planar layer of flexible material having a peripheral edge forming a generally U-shaped opening;

a generally U-shaped bead made of flexible material, the shapes and sizes of said U-shaped opening and said U-shaped bead being generally similar, said bead lying generally parallel to said layer and separated therefrom, and said bead being generally aligned with and overlying said peripheral edge of said layer when viewed from in front of said bead along a line of sight generally perpendicular to said layer; and means for connecting said bead to said layer.

13. The compound seal as recited in claim 12, wherein said bead, said layer and said connecting means are made of the same flexible material.

14. The compound seal as recited in claim 13, wherein said flexible material is rubber.

15. The compound seal as recited in claim 13, wherein said bead, said layer and said connecting means are parts of a single molded piece.

16. The compound seal as recited in claim 12, wherein said connecting means comprise a plurality of strips of flexible material, each strip having one end connected to said bead and another end connected to said layer.

17. The compound seal as recited in claim 12, wherein a plurality of holes are formed in said layer, said layer comprising a plurality of bosses, each boss encircling a respective one of said holes.

18. A jet-propelled boat comprising a hull, a mounting adapter mounted to said hull, a water jet propulsion system mounted to said mounting adapter, and a seal arranged at the interface of said hull and said mounting adapter, wherein said hull comprises a bottom, a wall and an inlet ramp which forms an opening in said bottom and an opening in said wall, said mounting adapter comprises a mounting flange which opposes a portion of said wall along a periphery of said opening in said wall, and said seal comprises a generally planar layer of flexible vibration isolation material arranged between and in contact with said portion of said wall and said mounting flange.

19. The boat as recited in claim 18, wherein said mounting adapter further comprises an inlet housing, said inlet ramp has a recess for receiving a leading portion of said inlet housing, and said seal further comprises a bead of flexible vibration isolation material placed in said recess, said bead sitting between and in contact with said inlet ramp and said leading portion of said inlet housing.

20. The boat as recited in claim 19, wherein said seal further comprises means for connecting said bead to said layer.

21. The boat as recited in claim 20, wherein said bead, said layer and said connecting means are made of the same flexible vibration isolation material.

22. The boat as recited in claim 21, wherein said flexible vibration isolation material is rubber.

23. The boat as recited in claim 20, wherein said bead, said layer and said connecting means are parts of a single molded piece.

24. The boat as recited in claim 20, wherein said connecting means comprise a plurality of strips of flexible material, each strip having one end connected to said bead and another end connected to said layer.

25. The boat as recited in claim 18, further comprising a fastener coupled to said mounting flange and penetrating an opening in said hull wall, wherein said layer of vibration isolation material comprises an opening penetrated by said fastener, and a boss encircling said opening in said layer and protruding into said opening in said hull wall, said fastener being sufficiently tightened that said vibration isolation material seals said opening in said hull wall.

26. A method of mounting a water jet propulsion system to a boat hull, comprising the step of inserting vibration isolation material between said water jet propulsion system and said boat hull at every point where, in the absence of said vibration isolation material, vibrations in said water jet propulsion system would be transmitted to said boat hull.

27. The method as recited in claim 26, further comprising the step of isolating said hull from fasteners penetrating said hull and coupled to said water jet propulsion system, said hull being isolated from said fasteners by surrounding each fastener with vibration isolation material.

28. A jet-propelled boat comprising:

a hull;

an inboard motor;

a shaft driven by said motor, said shaft penetrating said hull;

a duct mounted to said hull;

an impeller rotatable within said duct;

a flexible coupling for coupling said impeller to said shaft; and means for isolating said hull from vibrations in said duct during rotation of said impeller.

29. The boat as recited in claim 28, wherein said duct comprises a mounting flange, and said isolating means comprise a first seal made of vibration isolation material and placed at an interface between said mounting flange and said hull.

30. The boat as recited in claim 28, wherein said duct comprises an inlet housing, and said isolating means comprise a seal made of vibration isolation material and placed at an interface between said inlet housing and said hull.

31. The boat as recited in claim 29, wherein said duct further comprises an inlet housing, and said isolating means further comprise a second seal made of said vibration isolation material and placed at an interface between said inlet housing and said hull, wherein said first and second seals are connected by a plurality of strips of said vibration isolation material.

32. The boat as recited in claim 28, wherein said isolating means comprise a rubber seal.

* * * * *